US006619271B2

(12) United States Patent
Iwamoto et al.

(10) Patent No.: US 6,619,271 B2
(45) Date of Patent: Sep. 16, 2003

(54) FUEL SUPPLY APPARATUS

(75) Inventors: Takashi Iwamoto, Tokyo (JP); Toshihide Kimisawa, Yokohama (JP)

(73) Assignee: Nifco Inc., Yokohama (JP)

( * ) Notice: Subject to any disclaimer, the term of this patent is extended or adjusted under 35 U.S.C. 154(b) by 43 days.

(21) Appl. No.: 10/047,998

(22) Filed: Jan. 17, 2002

(65) Prior Publication Data

US 2002/0096220 A1 Jul. 25, 2002

(30) Foreign Application Priority Data

Jan. 24, 2001 (JP) ..... 2001-016170

(51) Int. Cl.[7] ..... F02M 37/04
(52) U.S. Cl. ..... 123/509
(58) Field of Search ..... 123/509; 417/151, 417/198, 159

(56) References Cited

U.S. PATENT DOCUMENTS 5,642,718 A * 7/1997 Nakai et al. ..... 123/497
5,769,061 A * 6/1998 Nagata et al. ..... 123/509
5,954,481 A * 9/1999 Baier et al. ..... 417/182
6,513,503 B2 * 2/2003 Iwanoto et al. ..... 123/509
2002/0000220 A1 * 1/2002 Hazama ..... 123/510

FOREIGN PATENT DOCUMENTS

JP 11-148432 6/1999

* cited by examiner

*Primary Examiner*—Thomas Moulis
(74) *Attorney, Agent, or Firm*—Kanesaka & Takeuchi

(57) ABSTRACT

A fuel supply apparatus has a sub tank inside a main tank that stores a fuel, and a jet pump nozzle inside the sub tank. A part of the fuel taken in from the sub tank to be supplied to an engine is sprayed from a tip of the jet pump nozzle. The fuel inside the main tank is drawn into the sub tank from a bottom part by a negative pressure caused by the jet pump nozzle. A holding device for holding the jet pump nozzle in the sub tank is provided between the sub tank and the jet pump nozzle when the jet pump nozzle is inserted into the sub tank. Therefore, it becomes possible to assemble the jet pump nozzle and the fuel supply system in advance outside the sub tank, and after that, to attach that jet pump nozzle to the sub tank.

8 Claims, 9 Drawing Sheets

221
53
50
55
56
54
51
52
421
420
422
410
40
431

221
53
421
420
51
55
56
410
40
431

222
221
53
420
51
55
56
410
40
500
52
431

FUEL SUPPLY APPARATUS

BACKGROUND OF THE INVENTION AND RELATED ART STATEMENT

The present invention relates to a fuel supply apparatus including a sub tank inside a main tank to supply a fuel inside the sub tank to an engine.

Conventionally, among fuel supply apparatuses applied to vehicles such as automobiles, there has been a type in which a sub tank is placed inside a main tank that stores a fuel. A sub tank is a fuel storage vessel, a cross section of which is sufficiently smaller than a main tank, and it has a fuel supply pump inside and has a jet pump at a position that connects the inside and the outside. A fuel supply pump is for taking in the fuel that is stored inside a sub tank and supplying this to an engine. The jet pump is for spraying a part of the fuel from a jet pump nozzle, and sucking a fuel stored in a main tank into the sub tank by using a negative pressure generated thereby.

According to a fuel supply apparatus as noted above, when the fuel supply pump is operated, the fuel inside the main tank is sucked into the sub tank by the jet pump, such that the fuel is always stored inside the sub tank. Accordingly, even when a liquid level of the fuel stored inside the main tank is temporarily lowered as a vehicle is inclined or due to centrifugal force on the vehicle, it becomes possible to assuredly supply the fuel stored inside the sub tank to an engine.

Incidentally, it is common that the jet pump described above is constituted at a bottom part of the sub tank in order to assuredly suck the fuel inside the main tank into the sub tank even when only a small amount of the fuel remains. Because of this, when the fuel supply apparatus is assembled, before the fuel supply pump is supported inside the sub tank, a channel for supplying a partial fuel ejected from the fuel supply pump must be connected to the jet pump nozzle which is provided on a bottom part of the sub tank. This operation must be performed inside an inner recess of the sub tank, and it becomes an issue that markedly complicates an assembly operation of the fuel supply apparatus.

The present invention has been made in view of the foregoing, and an object of the invention is to provide a fuel supply apparatus that simplifies an assembly operation thereof.

Further objects and advantages of the invention will be apparent from the following description of the invention.

SUMMARY OF THE INVENTION

In the present invention, a fuel supply apparatus has a sub tank inside a main tank that stores a fuel, and a jet pump nozzle inside this sub tank. A part of the fuel taken in from the sub tank to be supplied to an engine is sprayed from a tip of the jet pump nozzle. The fuel inside the main tank is drawn into the sub tank from a bottom part by a negative pressure caused by the jet pump nozzle. Holding means for holding the jet pump nozzle in the sub tank is provided between the sub tank and the jet pump nozzle when the jet pump nozzle is inserted into the sub tank.

It is preferable for the holding means to be provided on at least one of the sub tank and the jet pump nozzle, and to include an elastic engagement part that engages one of the sub tank and the jet pump nozzle elastically. Also, it is preferable that the holding means includes a position regulating part that regulates the position of the jet pump nozzle with respect to the sub tank.

When a tip of the jet pump nozzle is exposed to an outside of the sub tank, a recess portion is preferably formed on an outer surface of the sub tank, and the tip of the jet pump nozzle is positioned in the recess portion. A seal member for sealing a fuel supply channel is provided in the jet pump nozzle.

DETAILED DESCRIPTION OF PREFERRED EMBODIMENTS

Below, embodiments of the invention will be explained in detail with reference to accompanied drawings.

Figure 2:
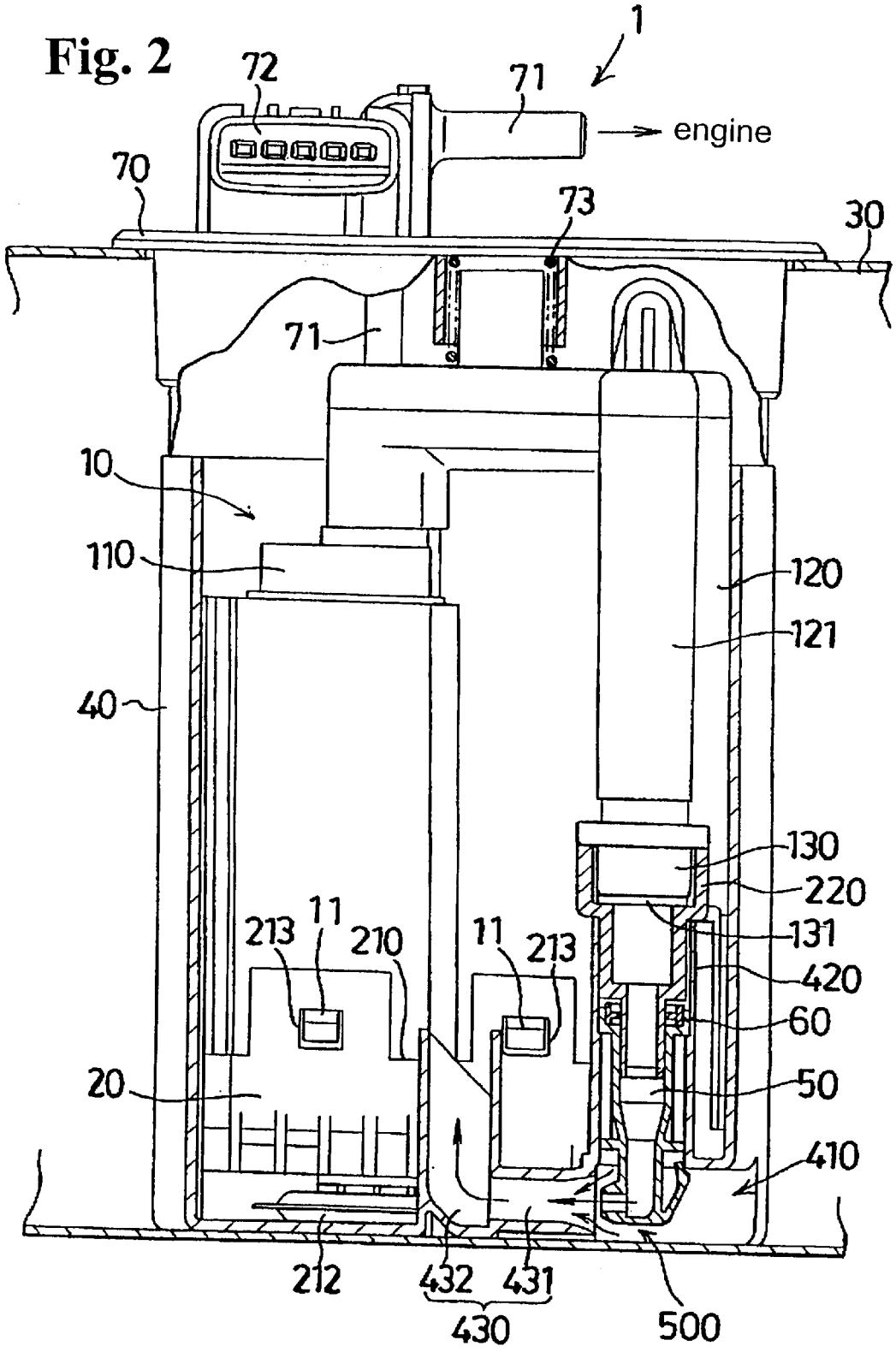
FIG. 2 is a sectional side view of essential components of a fuel supply apparatus in which a sub tank is attached to a main tank.

FIG. 2 shows one embodiment of a fuel supply apparatus according to the present invention. A fuel supply apparatus 1 is for supplying gasoline as fuel to an automobile engine (not shown), and it has a fuel supply module 10.

Figure 3:
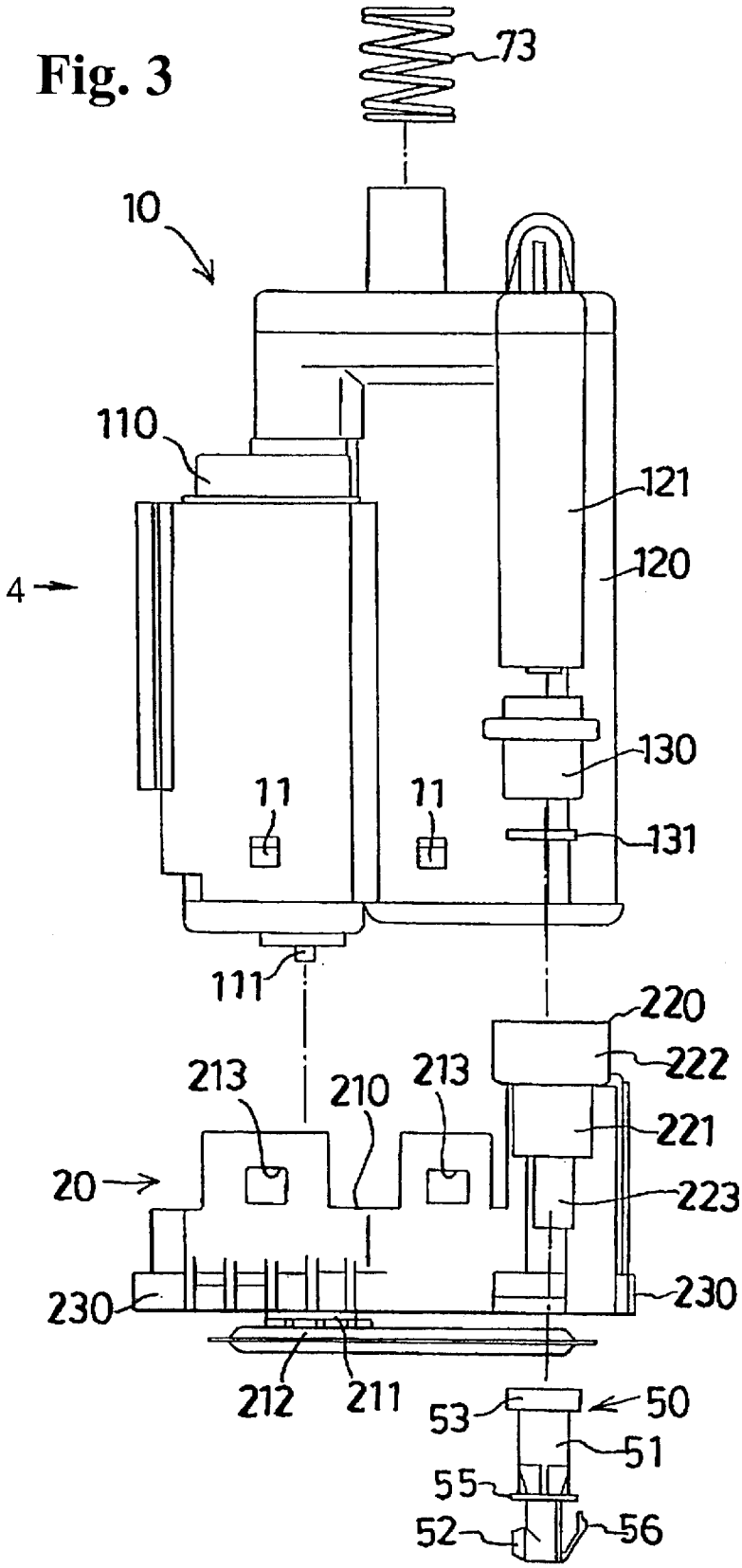
FIG. 3 is an exploded side view showing a fuel supply module and a jet pump nozzle to be disposed inside the sub tank.
Figure 4:
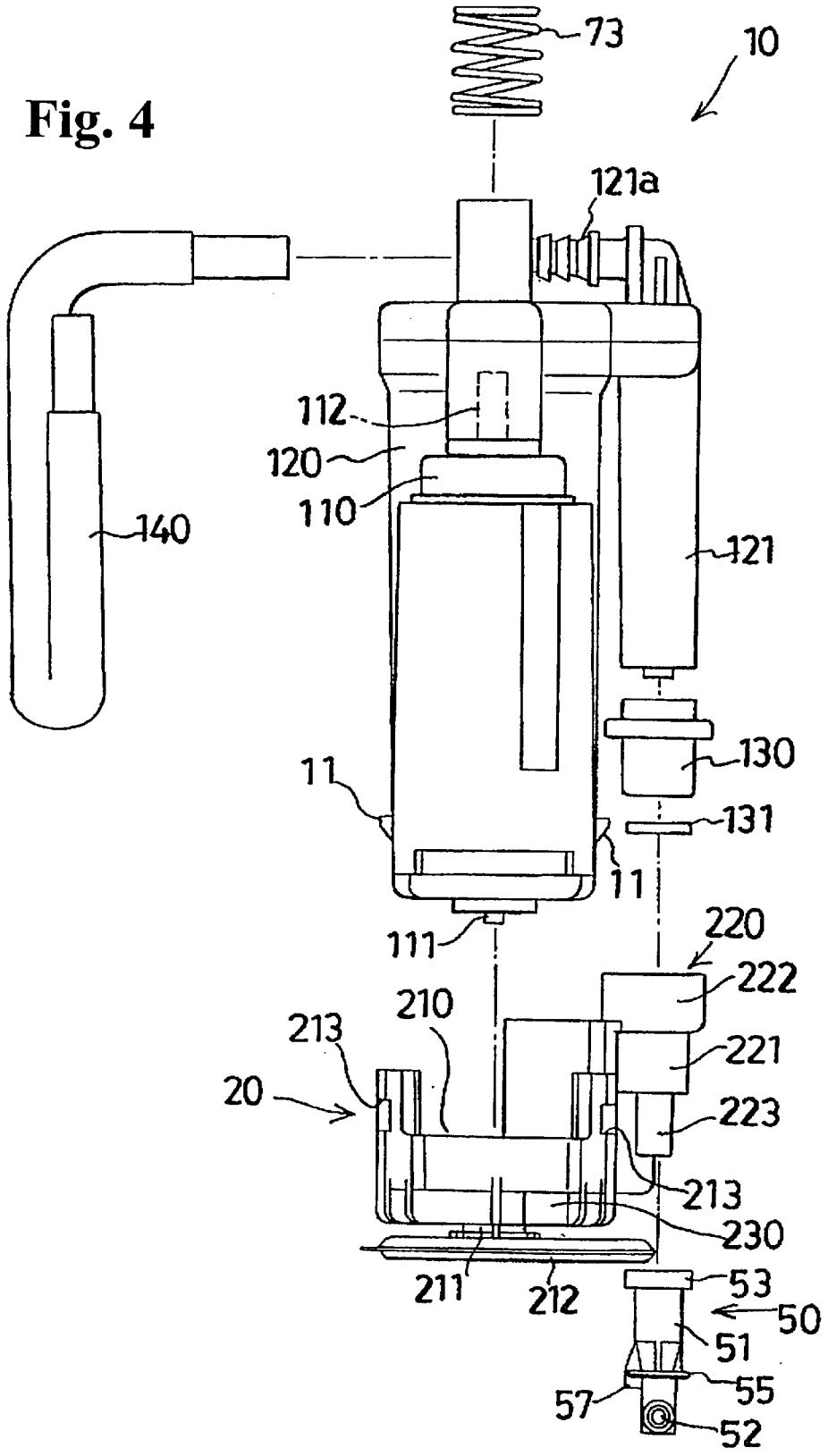
FIG. 4 is an exploded side view from the direction of arrow 4 in FIG. 3.

As shown in FIG. 3 and FIG. 4, a fuel supply module 10 includes a fuel supply pump 110; a fuel filter 120; a pressure regulator (pressure regulating means) 130; and a fuel delivery pipe 140. These constituents are made into one unit by a supporting bracket 20 in advance. The fuel supply pump 110 is an electric pump for sequentially discharging a fuel, which is sucked from a suction port 111 at a lower surface thereof, from a discharge port 112 at an upper surface thereof. The fuel filter 120 sequentially filters the fuel discharged from the fuel supply pump 110, and is disposed parallel to the fuel supply pump 110. In the fuel filter 120, a circulation pipe 121 is disposed downwardly from an upper portion of the fuel filter 120 to be externally attached. An inside of the circulation pipe 121 is provided with an ejection passage and a delivery passage (not shown), which are respectively independent from each other, and the circulation pipe 121 sequentially discharges the fuel filtered by the fuel filter 120 from the ejection passage.

Figure 8A:
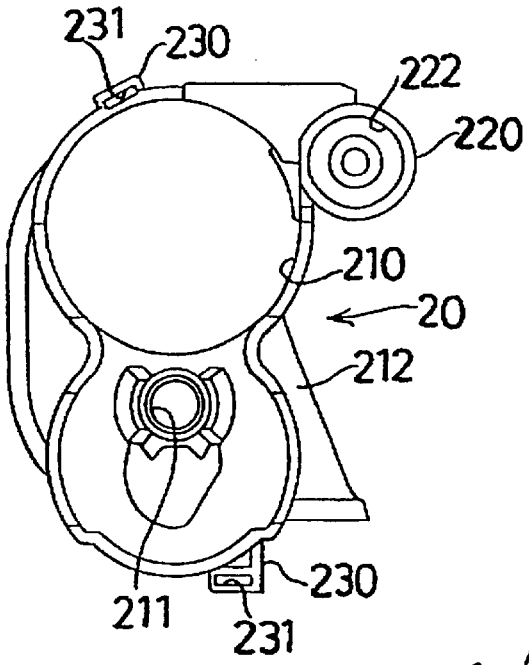
FIG. 8(*a*) is a plan view of a support bracket, FIG. 8(*b*) is a plan view of the sub tank, and FIG. 8(*c*) is a plan view showing a state in which the support bracket is attached to the sub tank.
Figure 8B:
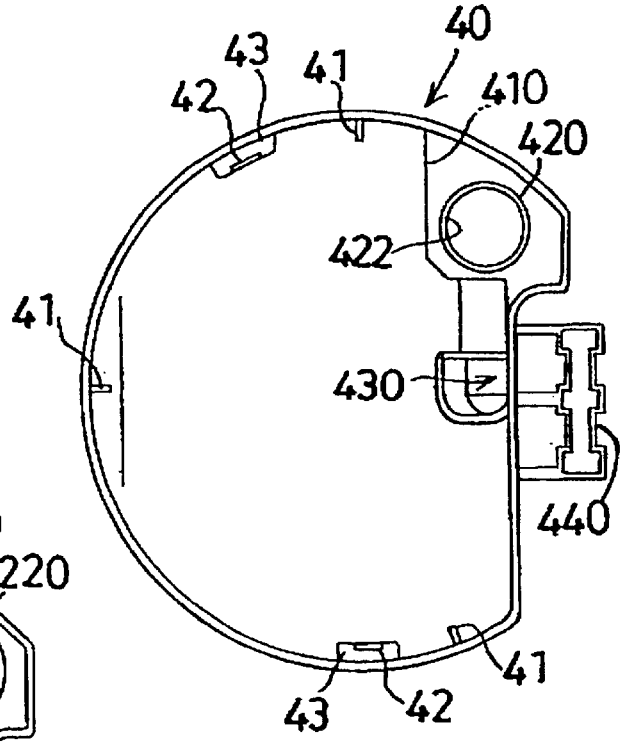
Figure 8C:
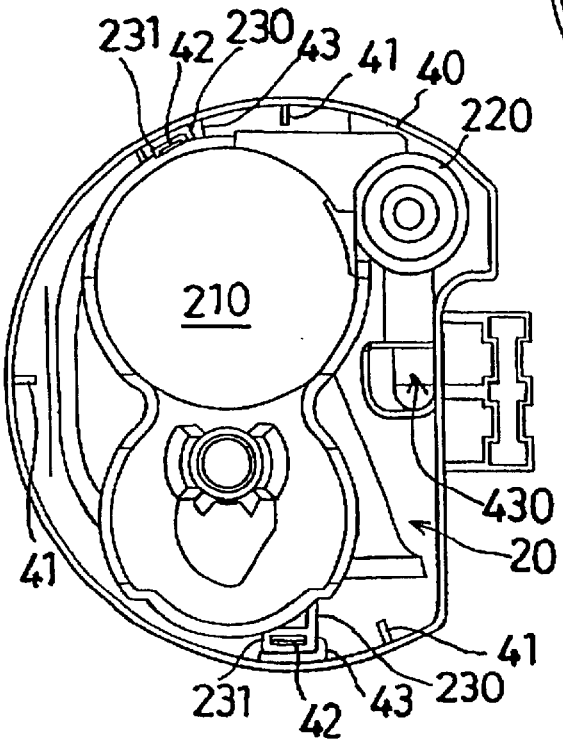

The supporting bracket 20 is formed of a hard synthetic resin with gasoline resistance, such as polyacetal, and includes a module accommodating section 210 and a jet pump supply passage 220 as shown in FIGS. 3, 4 and 8(*a*).

The module accommodating section 210 is a section to be fitted with lower sides of the fuel supply pump 110 and fuel filter 120, which are arranged parallel to each other. In the module accommodating section 210, a suction passage 211 is bored through a portion opposed to the suction port 111 of the fuel supply pump 110, so that the fuel can be sucked from the lower surface of the supporting bracket 20. Incidentally, numeral reference 212 shown in the figures denotes a simple filter provided for removing a relatively large dust from the fuel sucked through the suction passage 211. Also, numeral reference 213 denotes a notch with which an engagement claw 11 disposed at the fuel supply module 10 is engaged.

The jet pump supply passage 220 is a passage formed at a portion corresponding to the circulation pipe 121 of the fuel filter 120, and is formed integrally with the module accommodating section 210 described above. The jet pump supply passage 220 extends along a vertical direction. The jet pump supply passage 220 includes a regulator accommodating section 222 at an upper end portion of a passage main body 221, and a nozzle inserting section 223 at a lower end portion of the passage main body 221. The regulator accommodating section 222 is a portion that accommodates and holds the pressure regulator 130 described above by interposing a gasket 131 therebetween to thereby receive the fuel relieved from the lower surface of the pressure regulator 130. The nozzle inserting section 223 is a portion for guiding the fuel, which has passed through the passage main body 221, further downwardly, and has a diameter smaller than that of the passage main body 221. As clearly understood from the drawings, the jet pump supply passage 220 is disposed at a position higher than the module accommodating section 210, and the lower end portion of the nozzle inserting section 223 is located at the position higher than the lower surface of the module accommodating section 210.

Also, a plurality of projection inserting sections (positioning means) 230 is disposed at an outer peripheral portion of the supporting bracket 20. Each projection inserting section 230 projects outwardly from the outer peripheral surface of the supporting bracket 20, and has a positioning insertion hole 231 (refer to FIG. 8(*a*)) at each projecting end portion thereof. Each positioning insertion hole 231 has a slit form, and is bored through the projection inserting section 230 along the vertical direction. In the supporting bracket 20 of the present embodiment, the projection inserting sections 230 are formed at two places opposite to each other.

Moreover, the fuel supply apparatus 1 described above includes a sub tank 40 inside a main Lank 30 for storing the fuel. The sub tank 40 has a lateral cross section, which is sufficiently smaller than that of the main tank 30 and slightly larger than the fuel supply module 10, and has a form of a cylindrical body with a bottom. As in the supporting bracket 20, the sub tank 40 is formed of a hard synthetic resin with gasoline resistance, such as polyacetal.

Figure 5A:
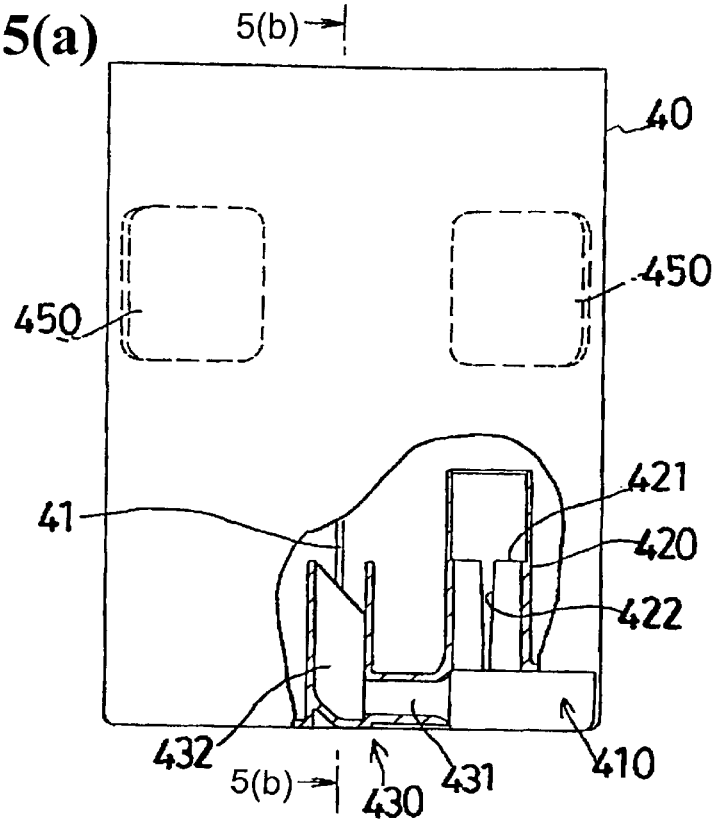
FIG. 5(*a*) is a side view in partial section of a sub tank, and FIG. 5(*b*) is a sectional view taken along line 5(*b*)–5(*b*) in FIG. 5(*a*)
Figure 5B:
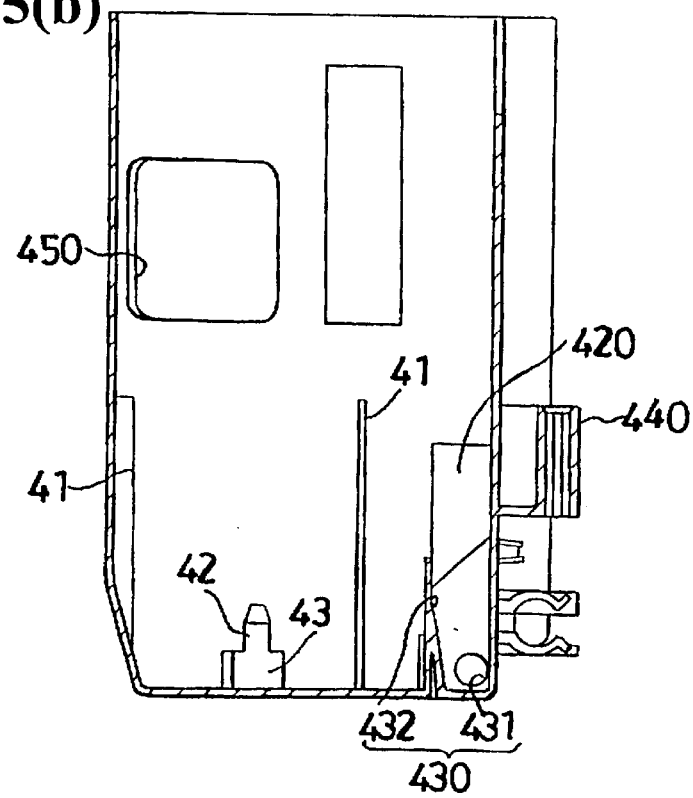

As shown in FIGS. 5(*a*), 5(*b*) and 8(*b*), an inside of the sub tank 40 is provided with three guide ribs 41, and also two positioning projections 42.

The guide ribs 41 are liner projecting portions, which project inwardly from an inner peripheral surface of the sub tank 40 and respectively extend along a vertical direction. The guide ribs 41 are disposed at a lower half portion of the sub tank 40 such that upper end surfaces of the respective guide ribs 41 are at the same height. In the sub tank 40 of the embodiment, three guide ribs 41 described above are disposed at substantially uniform intervals therebetween.

The positioning projections 42 are portions to be inserted into the positioning insertion holes 231 of the supporting bracket 20, and formed such that the width and thickness thereof are gradually reduced toward the upper side. Each positioning projection 42 projects vertically upwardly from an upper surface of each stand-like section 43 disposed on an inner bottom surface of the sub tank 40. The stand-like section 43 is disposed at a portion where the inner bottom surface of the sub tank 40 meets the inner surface thereof, and the stand-like sections 43 are disposed at the same height. Each stand-like section 43 is formed at such a height that a lower surface of the simple filter 212 abuts against the inner bottom surface of the sub tank 40 when the upper surface of each stand-like section 43 abuts against the lower surface of the supporting bracket 20.

Also, a recess portion 410 is formed on an outer front surface of the sub tank 40. As shown in FIGS. 5(*a*), 5(*b*), and FIGS. 8(*a*)–8(*c*), the recess portion 410 is formed at a position corresponding to the jet pump supply passage 220 in case the positioning projections 42 are inserted into the positioning insertion holes 231 of the supporting bracket 20, and the recess portion 410 is formed to open toward a lateral side and lower side at the bottom of the sub tank 40. A nozzle supporting cylinder body (supporting means) 420 and a fuel suction passage 430 are respectively opened to the recess portion 410.

As clearly understood from the drawings, the nozzle supporting cylinder body 420 is a cylindrical portion extending vertically upwardly from a ceiling surface of the recess portion 410, and has an upper end opened to the inside of the sub tank 40. The nozzle supporting cylinder body 420 is formed such that an inner diameter of a lower half portion thereof is slightly smaller than that of an upper half portion, and a step portion 421 is formed at a portion where the lower half portion meets the upper half portion.

The upper half portion of the nozzle supporting cylinder body 420 has the inner diameter which allows the passage main body 221 of the jet pump supply passage 220 provided in the supporting bracket 20 to be inserted therein. The lower half portion of the nozzle supporting cylinder body 420 is provided with a single direction defining groove 422 (supporting means) along the vertical direction. The single direction defining groove 422 is formed to have a width that is gradually increased toward the upper side. The nozzle supporting cylinder body 420 is formed in such a height that an upper end of the nozzle supporting cylinder body 420 agrees with a boundary between the regulator accommodating section 222 and the passage main body 221 of the jet pump supply passage 220 when the lower surface of the supporting bracket 20 abuts against the upper surfaces of the stand-like sections 43.

The fuel suction passage 430 extends horizontally from a side surface of the recess portion 410 toward the lateral direction, and is bent vertically upwardly thereafter. An upper end portion of the fuel suction passage 430 is opened to the inside of the sub tank 40. In the fuel suction passage 430, a lateral cross section of a horizontally extending portion 431 has a circular shape, and an end portion thereof opened to the recess portion 410 has a funnel form in which an inner diameter thereof is gradually increased outwardly. On the other hand, a vertically extending portion 432 of the fuel suction passage 430 has a substantially square tube form, and an inner diameter thereof is sufficiently larger than that of the horizontally extending portion 431. Because the open end of the part extending in the vertical direction of the fuel intake channel 430 is positioned toward the center of the nearly circular bottom surface of the sub tank 40 and is set to a position close to nearly the center in the longitudinal direction of the simple filter 212, the efficiency of fuel intake inside the sub tank 40 is very good.

The symbol 440 in the drawing is a holding part for holding the gauge assembly of the main tank 30, and the symbol 450 is an opening for overflow.

Figure 1:
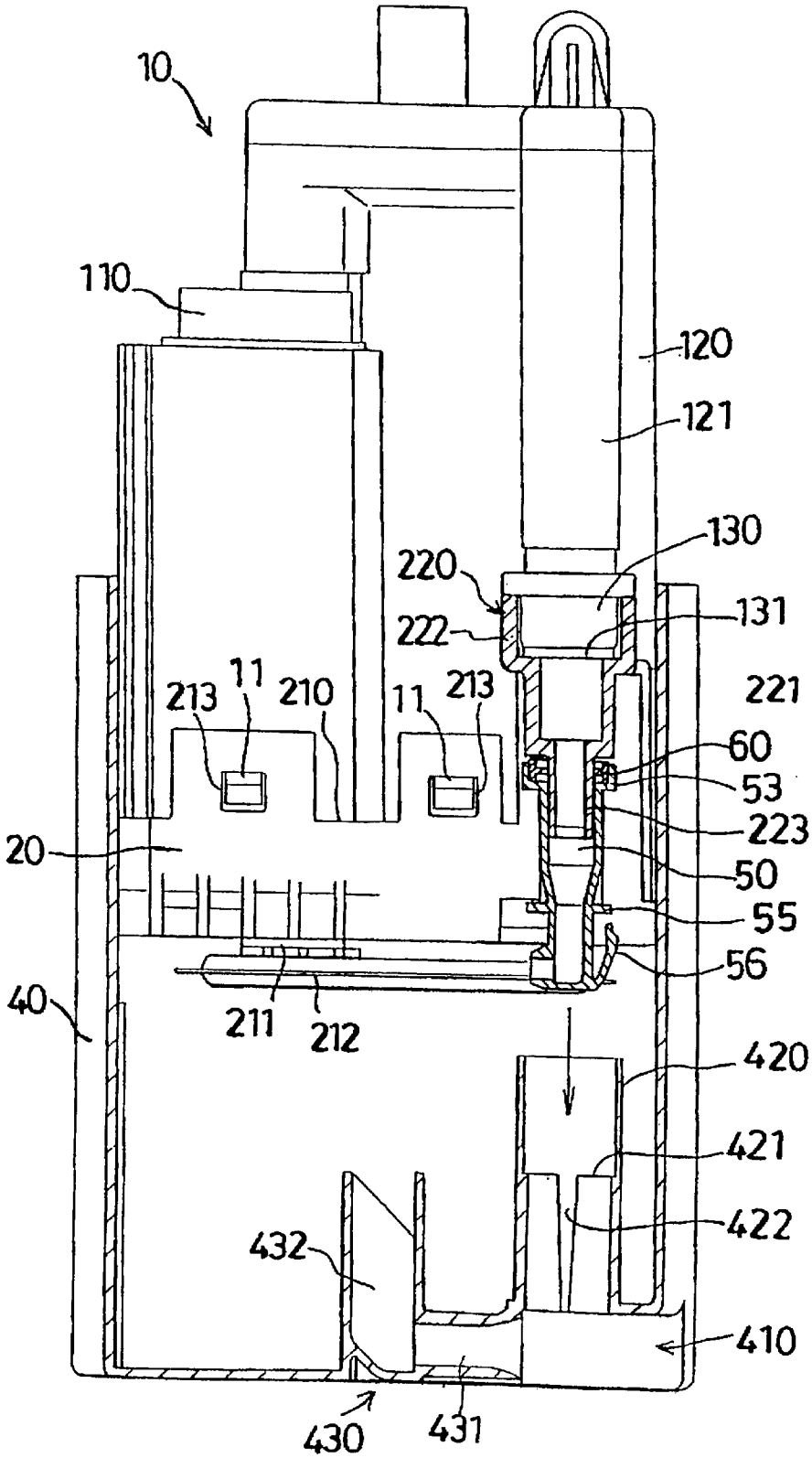
FIG. 1 shows a sectional side view of a fuel supply apparatus in an assembled state.
Figure 6A:
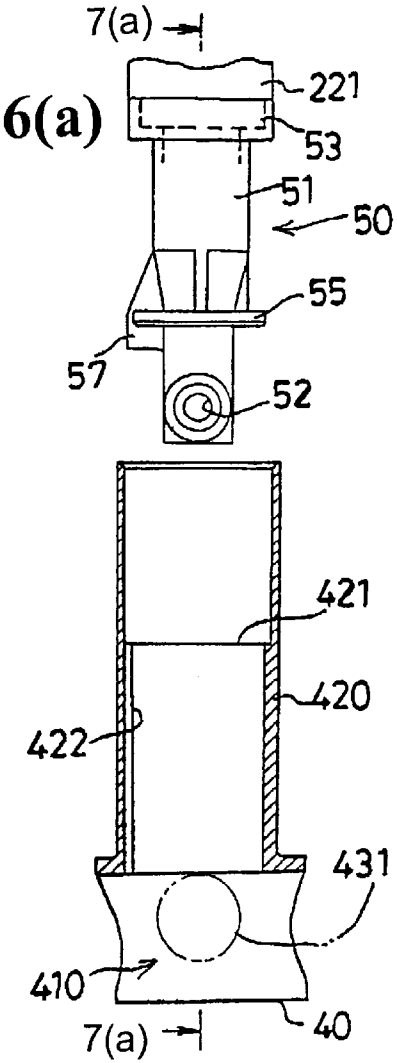
FIGS. 6(*a*)–6(*c*) are side views of essential components showing in sequence of assembling process of a jet pump nozzle.
Figure 6B:
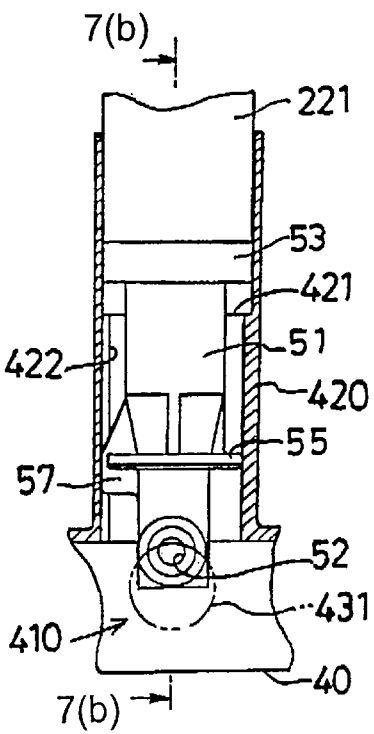
Figure 6C:
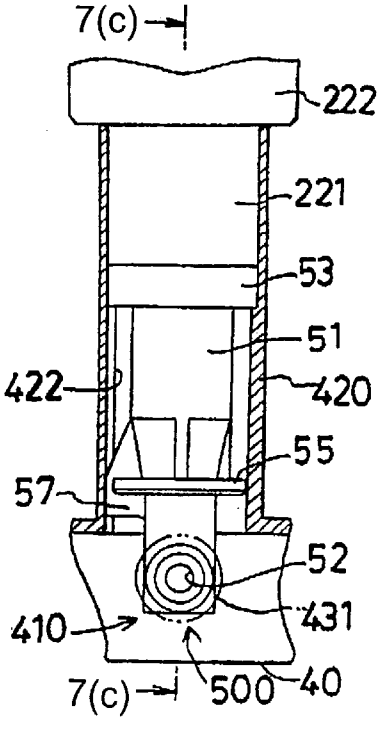

Furthermore, the fuel supply apparatus 1 described above has a jet pump nozzle 50. The jet pump nozzle 50, as shown in FIG. 1, FIG. 6(*a*)–FIG. 6(*c*), and FIG. 7(*a*)–FIG. 7(*c*), has a single spray port 52 on a peripheral surface of a tip of a nozzle main body 51 that forms a cylindrical shape, and just as in the sub tank 40, it is formed of a hard synthetic resin with gasoline tolerance such as polyacetal. An inner diameter of the nozzle main body 51 is formed to a size such that the nozzle inserting section 223 of the jet pump supply passage 220 provided in the supporting bracket 20 can be fitted therewith. The part constituting the spray port 52 of the nozzle main body 51 is formed such that its outer perimeter is slightly smaller than the inner diameter of the part 431 extending horizontally of the fuel intake channel 430 and furthermore the outer perimeter gradually becomes smaller toward the tip.

In this jet pump nozzle 50, there are provided a large positioning flange (holding means) 53, a seal holding part 54, a small positioning flange (holding means) 55, an elastic engaging piece (holding means) 56, and a direction regulating rib (holding means) 57.

The large positioning flange 53 is a part that has an outer diameter that couples into the upper half part inside the nozzle supporting cylinder body 420 of the sub tank 40, and it is provided on the base part of the nozzle main body 51.

The seal holding part 54 is constituted by forming the inner perimeter of the large positioning flange 53 to have a larger diameter, and it holds an annular seal member 60 inside. An outer diameter of the seal member 60 is constructed to be slightly larger than an inner diameter of the seal holding part 54, and it is held by the seal holding part 54 in a slightly bent state. Also, an inner diameter of the seal member 60 is constructed to be slightly smaller than an inner diameter of the nozzle insertion part 223 of the jet pump supply channel 220 described above.

The small positioning flange 55 is a part that has an outer diameter that couples with the lower half part inside the nozzle supporting cylinder body 420, and it is provided roughly in a center part of the nozzle main body 51.

The elastic engaging piece 56 is a part that gradually extends outward toward a base from a tip in a position shifted 180 degrees with respect to the spray port 52. This elastic engaging piece 56 is elastically deformable following the radial direction of the nozzle main body 51, and its extended end in the free state is positioned outward of the outer perimeter surface of the large positioning flange 53.

The direction regulating rib 57 is a linear projection that extends in a middle part of the nozzle main body 51 following the axial direction of the nozzle main body 51. The direction regulating rib 57 extends higher than the small positioning flange 55 and is located at a position substantially identical to the large positioning flange 53. The direction regulating rib 57 is provided in a position that matches the direction regulating groove 422 of the nozzle supporting cylinder body 420 when the axial center of the nozzle main body 51 matches the axial center of the nozzle supporting cylinder body 420 and the axial center of the spray port 52 matches a vertical surface including the axial center of the fuel intake channel 430.

When assembling the fuel supply apparatus 1 described above, the fuel supply module 10 is made as a unit in advance with the support bracket 20, and in addition, the jet pump nozzle 50 is installed in the nozzle insertion part 223 of the jet pump supply channel provided on the support bracket 20. The work of assemble involves connecting the fuel supply pump 110, the fuel filter 120, the pressure regulator 130, and the fuel lead-out pipe 140 together which constitute the fuel supply module 10, attaching these to the support bracket 20, and installing the jet pump nozzle 50 on the nozzle insertion part 223 of the jet pump supply channel 220. Because all of these steps may be performed outside the sub tank 40, they can be carried out extremely easily. When installing the jet pump nozzle 50 on the nozzle insertion part 223 of the support bracket 20, it is preferable from the relative positions of the sub tank 40 and the support bracket 20 that the orientation of the spray port 52 be generally set so as to oppose the opening of the fuel intake channel 430 of the sub tank 40.

Next, as shown in FIG. 1, the fuel supply module 10 made as a unit is successively installed inside the sub tank 40 in a state in which the jet pump supply channel 220 of the support bracket 20 fits the nozzle supporting cylinder body 420.

At that time, first, the tip of the jet pump nozzle 50 provided in the nozzle insertion part 223 of the support bracket 20 is inserted into the nozzle supporting cylinder body 420, and then the small positioning flange 55 and the large positioning flange 53 of the jet pump nozzle 50 successively are inserted inside that nozzle supporting cylinder body 420. Therefore, by their coordination, the support bracket 20 is guided inside the sub tank 40, and the positioning tabs 42 are easily inserted into the respective positioning insertion holes 231 of the support bracket 20.

During this operation, as shown in FIG. 6(*a*)–FIG. 6(*c*), the direction regulating rib 57 provided on the jet pump nozzle 50 is successively inserted in the direction regulating groove 422 provided on the nozzle supporting cylinder body 420. With the direction regulating rib 57 and direction regulating groove 422, the direction of the jet pump nozzle 50 with respect to the sub tank 40 is precisely regulated at a point when the large positioning flange 53 abuts against the step part 421. At that time, because the direction regulating groove 422 is formed such that a width gradually becomes wider upward, it is possible to accept the direction regulating rib 57 even when the orientation of the jet pump nozzle is somewhat shifted. After that, the orientation of the jet pump nozzle 50 is corrected as the direction regulating rib 57 advances.

Figures 7A, 7B, 7C:
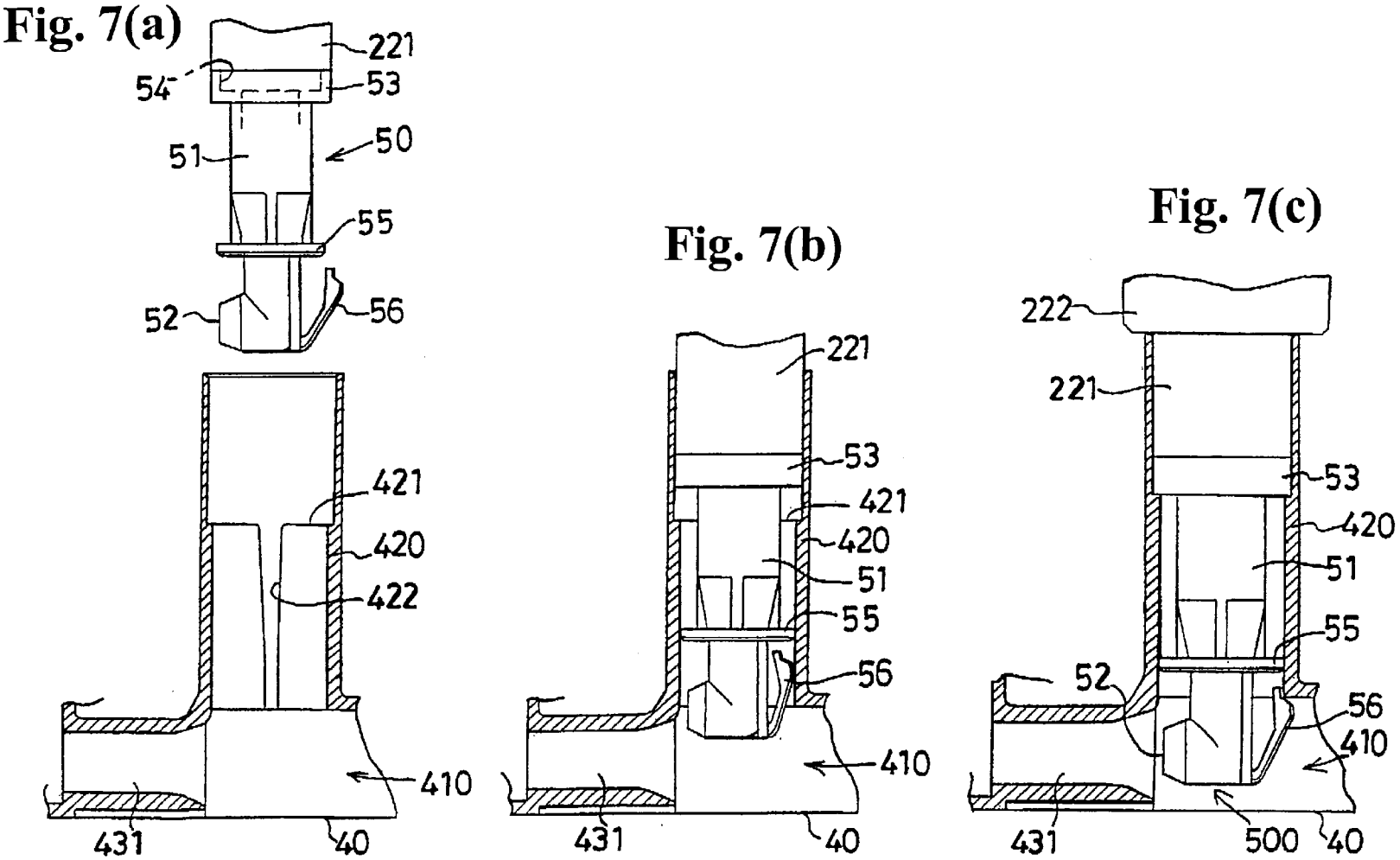
FIG. 7(*a*) is a sectional view taken along line 7(*a*)–7(*a*) in FIG. 6(*a*), FIG. 7(*b*) is a sectional view taken along line 7(*b*)–7(*b*) in FIG. 6(*b*), and FIG. 7(*c*) is a sectional view along line 7(*c*)–7(*c*) line in FIG. 6(*c*)

The elastic engaging piece 56 of the jet pump nozzle 50, as shown in FIG. 7(*a*) to FIG. 7(*b*), elastically deforms inward in the course of insertion into the nozzle supporting cylinder body 420, and it allows insertion into the nozzle supporting cylinder body 420 of the jet pump nozzle 50. After that, as shown in FIG. 7(*c*), when the large positioning flange 53 abuts against the step part 421, it extends outward in the radial direction, and its extended end engages an opening of the nozzle supporting cylinder body 420, and therefore, the jet pump nozzle 50 is prevented from accidentally falling out from the nozzle supporting cylinder body 420.

In FIG. 6(*c*) and FIG. 7(*c*), the spray port 52 of the nozzle main body 51 faces an opening of the fuel intake channel 430 outside the sub tank 40, and their axial centers match each other. As a result, a jet pump 500 is formed in the fuel intake channel 430. The tip of the jet pump nozzle 50 that is exposed to the outside of the sub tank 40 in this jet pump 500 is positioned inside the recess portion 410 provided on that sub tank 40. Accordingly, when handling the sub tank 40 after an installation of the jet pump 500, the jet pump nozzle 50 will not hit other objects accidentally, and no impact or damage will be applied to the jet pump nozzle 50.

Also in FIG. 6(*c*) and FIG. 7(*c*), when the jet pump nozzle 50 is pushed toward the inside of the sub Lank 40 while bending the elastic engaging piece 56 inward, it is possible to remove the jet pump nozzle 50 from the nozzle supporting cylinder body 420.

After a lower surface of the support bracket 20 abuts against an upper surface of the stand-like section 43, the fuel lead-out pipe 140 is connected to a supply part 71 on a flange body 70, and in addition, a lead line of the fuel supply pump 110 (not shown) is connected to a connector 72 on the flange body 70. Furthermore, the flange body 70 covers the opening on the upper end of the sub tank 40 while a coil spring 73 is interposed between the fuel supply module 10 and the flange body 70.

Finally, the sub tank 40 covered by the flange body 70 may be set inside the main tank 30 in which a bottom surface of the sub tank 40 abuts against an inner bottom surface of the main tank 30. When a drive signal is applied to the fuel supply pump 110 through the connector 72 on the flange body 70, the fuel inside the sub tank 40 is supplied to an engine through the fuel filter 120, the pressure regulator 130, the fuel lead-out pipe 140, and the supply part 71 on the flange body 70 by the fuel supply pump 110. The pressure regulator 130 controls a pressure of the fuel supplied to an engine at a constant value.

The fuel relieved by the pressure regulator 130 is supplied to the jet pump nozzle 50 through the jet pump supply channel 220 provided on the support bracket 20, and it is sprayed from the spray port 52. When the fuel is sprayed from the jet pump nozzle 50, because a negative pressure,is generated when the sprayed fuel passes through the fuel intake channel 430, the fuel stored in the main tank 30 is sucked into the sub tank 40 from the periphery of the jet pump nozzle 50 together with the fuel sprayed from the jet pump nozzle 50. Furthermore, because the fuel intake channel 430 extends vertically upwards inside the sub tank 40, even when the fuel is not sprayed from the jet pump nozzle 50, the fuel stored in the sub tank 40 will not flow back to the main tank 30 through the fuel intake channel 430. As a result, the fuel is always stored in the sub tank 40, and even when the liquid level of the fuel stored inside the main tank 30 is temporarily lowered as an automobile is inclined or due to centrifugal force acting on a body, it becomes possible to supply the fuel to the engine.

As explained above, according to the fuel supply apparatus 1, because the jet pump nozzle 50 is held as it is by inserting the jet pump nozzle 50 in the nozzle supporting cylinder body 420 from the inside of the sub tank 40, it is possible to attach the jet pump nozzle 50 to the sub tank 40 in a state in which the whole fuel supply system from the fuel supply pump 110 to this jet pump nozzle 50 is assembled in advance outside the sub tank 40. Since the operation of connecting a fuel supply system inside the sub tank 40 is eliminated, it becomes possible to greatly simplify the assembly operation of the fuel supply apparatus 1.

Figure 9:
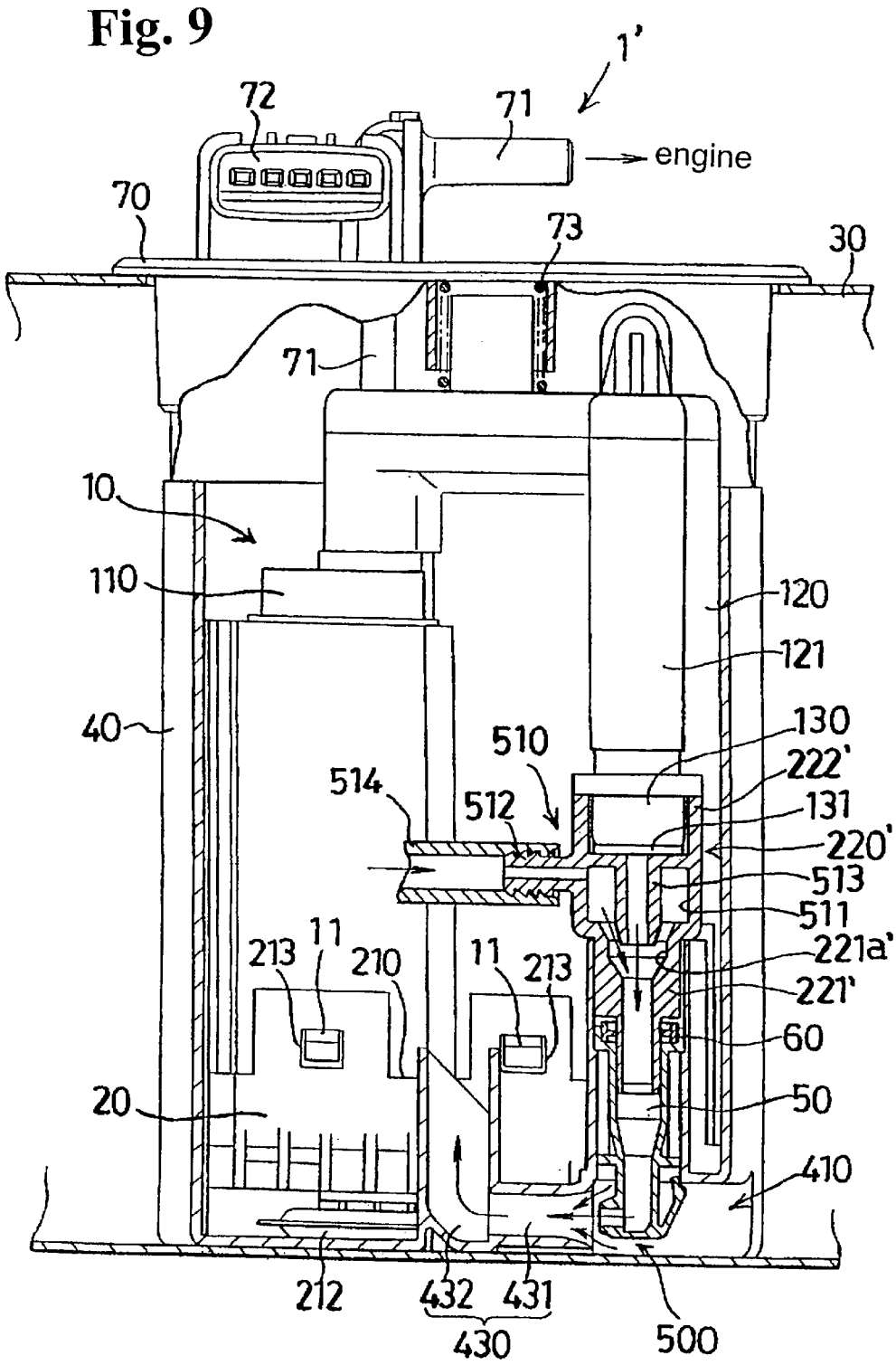
FIG. 9 is a sectional side view showing a modified example of a fuel supply apparatus according to the present invention.

FIG. 9 shows a modified example of the fuel supply apparatus pertaining to the present invention. The fuel supply apparatus 1' shown as an example here, just as the fuel supply apparatus 1 shown previously, is for supplying fuel to an automobile engine, and it differs from the previous embodiment in the point that a second jet pump 510 is provided in the jet pump supply channel 220' on the support bracket 20.

In the fuel supply apparatus 1' of this modified example, the second jet pump 510 is provided in an upper end of a channel main body part 221' which extends vertically, and furthermore a regulator receiving part 222' is provided on an upper end of the second jet pump 510.

The second jet pump 510 is formed by a negative pressure chamber 511, a second fuel intake channel 512 and a fuel spray channel 513. The negative pressure chamber 511 forms a round columnar shape that is sufficiently wider than a center hole 221*a'* of the channel main body part 221', and it is connected to the center hole 221*a'* of the channel main body part 221'. As for the center hole 221*a'* of the channel main body part 221' which is connected to this negative pressure chamber 511, its upper end forms a funnel shape in which an inner diameter is gradually increased upwardly. The second fuel intake channel 512 extends out in the radial direction from the negative pressure chamber 511, and it connects together the inside and the outside of the negative pressure chamber 511. The fuel spray channel 513 is for spraying the fuel that is relieved from the lower side of the pressure regulator 130 into the center hole 221*a'* of the channel main body part 221'. This fuel spray channel 513 projects downwardly from a center part of the regulator receiving part 222', passes through a center part of the negative pressure chamber 511, and then reaches at its tip a part that is formed in a funnel shape in the center hole 221*a'* of the channel main body part 221'. The projecting end of the fuel spray channel 513 is formed such that its outer perimeter gradually becomes smaller downward downwardly.

In the fuel supply apparatus 1' of this modified example, in regard to the same structures as in the fuel supply apparatus 1 of the previous embodiment, the same symbols are used and their individual detailed explanations are omitted.

In the fuel supply apparatus 1' of the modified example, when a drive signal is applied to the fuel supply pump 110 through the connector 72 on the flange body 70, the fuel inside the sub tank 40 is supplied to an engine through the fuel filter 120, the pressure regulator 130, the fuel lead-out pipe 140, and the supply part on the flange body 70 by the fuel supply pump 110. The pressure regulator 130 controls a pressure of the fuel supplied to the engine at a constant value.

The fuel relieved by the pressure regulator 130 is supplied to the jet pump nozzle 50 through the jet pump supply channel 220 provided on the support bracket 20, and it is sprayed from the spray port 52. When the fuel is sprayed from the jet pump nozzle 50, because a negative pressure is generated when the sprayed fuel passes through the fuel intake channel 430, the fuel stored in the main tank 30 is sucked into the sub tank 40 from the periphery of the jet pump nozzle 50 together with the fuel sprayed from the jet pump nozzle 50. During this process, in the second jet pump 510, the fuel relieved from the lower side of the pressure regulator 130 is sprayed from the fuel spray channel 513, and when it passes through the center hole 221*a'* of the channel main body part 221', a negative pressure is generated in the negative pressure chamber 511. Accordingly, for example, even when the main tank 30 with divided bottoms, such as a saddle shape, is used, it is possible to transfer the fuel stored in the divided bottoms to the sub tank through the second fuel intake channel 512 when a pipe 514 is provided to connect the second fuel intake channel 512 and the divided bottoms.

Moreover, just as in the previous embodiment, in regard to its assembly, because the jet pump nozzle 50 can be attached to the sub tank 40 after the whole fuel supply system from the fuel supply pump 110 to the jet pump nozzle 50 and the fuel supply system to the second jet pump 510 are assembled in advance outside the sub tank 40, the operation of connecting the fuel supply system inside the sub tank 40 is eliminated. The assembly operation of the fuel supply apparatus 1' becomes very simple.

Furthermore, according to the fuel supply apparatus 1' of the modified example, because the second jet pump 510 is constituted in an upper region of the nozzle supporting cylinder body 420 in the sub tank 40, there is no need to provide a space dedicated for the second jet pump 510 in the sub tank 40, and it becomes beneficial in the point of space efficiency.

In the embodiments described above, the fuel supply apparatus uses a fuel relieved from a pressure regulator to spray from the jet pump nozzle. However, it can be applied to a fuel supply apparatus that uses the fuel returned as surplus after supplying to an engine to spray from the jet pump nozzle.

Also, in the embodiments described above, the fuel supply apparatus has the support bracket for accommodating and holding the fuel supply pump in the sub tank, and the jet pump supply channel for supplying fuel to the jet pump nozzle is provided on this support bracket. However, the support bracket is not an essential part. As means for supplying the fuel to the jet pump nozzle, it is possible to provide the jet pump supply channel that is not a hard part, rather is elastically deformable like the fuel lead-out pipe described above. In the embodiments described above where the jet pump supply channel is provided on the support bracket, the jet pump supply channel becomes a hard part, and when the support bracket is positioned with respect to the sub tank, it is possible to position the jet pump supply channel with respect to the nozzle supporting cylinder body. Accordingly, when a pre-assembled fuel supply module along with the support bracket is accommodated and provided inside the sub tank with only the jet pump nozzle installed in the nozzle supporting cylinder body of the sub tank, it is still possible to connect the jet pump supply channel and the jet pump nozzle.

According to the present invention as explained above, the fuel supply apparatus has the sub tank inside the main tank that stores a fuel, and the jet pump nozzle inside this sub tank. A part of the fuel taken in from the sub tank to be supplied to an engine is sprayed from the tip of the jet pump nozzle. The fuel inside the main tank is drawn into the sub tank from a bottom part by a negative pressure caused by the jet pump nozzle. Holding means for holding the jet pump nozzle in the sub tank is provided between the sub tank and the jet pump nozzle when the jet pump nozzle is inserted into the sub tank. Therefore, it becomes possible to assemble the jet pump nozzle and the fuel supply system in advance outside the sub tank, and after that, to attach that jet pump nozzle to the sub tank. Accordingly, the operation of connecting the jet pump nozzle and the fuel supply system inside the inner recesses of the sub tank is eliminated, and it is possible to greatly simplify the assembly operation of the fuel supply apparatus.

While the invention has been explained with reference to the specific embodiments of the invention, the explanation is illustrative and the invention is limited only by the appended claims.

What is claimed is:

1. A fuel supply apparatus for supplying a fuel to an engine, comprising:

a main tank for storing the fuel therein, a sub tank disposed inside the main tank, a jet pump having a jet pump nozzle disposed inside the sub tank for generating a negative pressure for sucking the fuel inside the main tank into the sub tank, and supporting means formed inside the sub tank for supporting the jet pump nozzle when the jet pump nozzle is attached to the sub tank, said supporting means being provided on one of the sub tank and the jet pump nozzle, and having an elastic engagement portion for engaging the sub tank and the jet pump nozzle.

2. A fuel supply apparatus according to claim 1, wherein said supporting means further includes positioning means for regulating a position between the sub tank and the jet pump nozzle.

3. A fuel supply apparatus according to claim 1, wherein said sub tank further includes a recess portion in an outer surface thereof, and a tip of the jet pump nozzle is positioned at the recess portion.

4. A fuel supply apparatus according to claim 1, wherein said jet pump nozzle is provided with sealing means for sealing the jet pump.

5. A fuel supply apparatus according to claim 4, wherein said supporting means includes a cylindrical portion located at a bottom of the sub tank and integrally formed therewith, said cylindrical portion extending vertically upwardly from a ceiling surface of the recess portion and having an upper end opened to an inside of the sub tank.

6. A fuel supply apparatus for supplying a fuel to an engine, comprising:

a main tank for storing the fuel therein, a sub tank disposed inside the main tank, and having a recess portion in an outer surface thereof, a jet pump having a jet pump nozzle disposed inside the sub tank for generating a negative pressure for sucking the fuel inside the main tank into the sub tank, said jet pup nozzle having a tip positioned at the recess portion, and supporting means formed inside the sub tank for supporting the jet pump nozzle when the jet pump nozzle is attached to the sub tank, said supporting means having a cylindrical portion located at a bottom of the sub tank and integrally formed therewith, said cylindrical portion extending vertically upwardly from a ceiling surface of the recess portion and having an upper end opened to an inside of the sub tank, said cylindrical portion including an upper half portion, a lower half portion having an inner diameter smaller than that of the upper half portion and a single direction defining groove extending along a longitudinal direction of the cylindrical portion, and a step portion formed between the upper and lower half portions.

7. A fuel supply apparatus according to claim 6, wherein said jet pump includes a large positioning flange formed at an upper portion thereof and having a seal holding therein, a small positioning flange under the large positioning flange, an elastic engaging piece as holding means, and a direction regulating rib at a side surface thereof.

8. A fuel supply apparatus according to claim 7, wherein when the jet pump is assembled with the cylindrical portion, the large positioning flange is located in the upper half portion on the step portion; the small positioning flange is located in the lower half portion; the elastic engaging piece engages an edge of the lower half portion; and the direction regulating rib is located in the single direction defining groove.

* * * * *